US007771167B2

(12) United States Patent
Fu

(10) Patent No.: US 7,771,167 B2
(45) Date of Patent: Aug. 10, 2010

(54) CONCEALED ROTARY FAN

(75) Inventor: Chiao Fu, Tamtzu Hsiang (TW)

(73) Assignee: King Jih Enterprise Corp., Tamtzu Hsiang, Taichung County (TW)

( * ) Notice: Subject to any disclaimer, the term of this patent is extended or adjusted under 35 U.S.C. 154(b) by 715 days.

(21) Appl. No.: 11/759,842

(22) Filed: Jun. 7, 2007

(65) Prior Publication Data

US 2008/0304966 A1 Dec. 11, 2008

(51) Int. Cl.
*F04D 29/18* (2006.01)

(52) U.S. Cl. ..... 416/100; 416/108; 416/170 R; 416/244 R

(58) Field of Classification Search ..... 415/122.1; 416/78, 100, 108, 170 R, 244 R
See application file for complete search history.

(56) References Cited

U.S. PATENT DOCUMENTS 2,313,481 A * 3/1943 Louis ..... 416/100
2,900,127 A * 8/1959 Smith ..... 417/423.15
6,015,262 A * 1/2000 Huang ..... 416/100
7,052,242 B2 * 5/2006 Chen ..... 417/423.3

* cited by examiner

*Primary Examiner*—Ninh H Nguyen
(74) *Attorney, Agent, or Firm*—Egbert Law Offices PLLC

(57) ABSTRACT

The concealed rotary fan includes a rotary vane, a drive motor and a base. The drive motor is assembled into the base. The first end of the drive motor with the revolving shaft can be assembled onto a front support in a rotary state. The second end of the drive motor is fitted with a crank link, the first end of which can be driven to make the second end rotate. The second end is screwed onto a pivot point on to the base. When the revolving shaft of the drive motor rotates, the second end of the crank link will rotate synchronously, enabling the drive motor and revolving shaft to rotate axially and obliquely along with the rotary vane. Thus, the rotary fan allows automatic change of the outlet direction through the axial rotation of the rotary vane, the outlet area being expanded to improve the actual applicability.

12 Claims, 12 Drawing Sheets

CONCEALED ROTARY FAN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a rotary fan, and more particularly to an innovative fan with a concealed rotary mechanism.

2. Description of Related Art Including Information Disclosed Under 37 CFR 1.97 and 37 CFR 1.98

The rotary fan of the present invention is used to supply air through the rotary vane.

Currently available rotary fans are generally divided into oscillating and rotating types in terms of outlet direction control. Oscillating fans drive the fan headstock to change the outlet direction through oscillating motion. However, since the oscillating fan shifts reciprocally along the same path, the outlet area cannot be expanded vertically, making it unsuitable for certain operating requirements. On the other hand, since the pivot point of the oscillating rotary fan is located at the lower rear of the headstock, the casing of the rotary vane will shift extensively around this point, thus making the rotary fan require greater volume and space during use.

As for the rotating fan, the outlet direction could be changed through a guide cage assembled onto the fan housing. However, the guide cage is implemented through the inclined plates, while the oblique plane of the inclined plate will impede the air current to some extent, leading to a much lower air supply effect.

As most of industrial rotary fans have to meet demanding air supply requirements, the rotary vane is generally made of metal sheets, and the casing is positioned reliably by a grounding support structure. While the oscillating function of some industrial rotary fans is often removed for more reliable operation, both the outlet area and applicability is reduced. The operator has to manually change the wind direction of the rotary fan, bringing about safety issues arising from the sharp rotary vane (especially in the operating state).

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The present invention provides an innovative concealed rotary fan. When the casing 10 is not activated, the rotary fan A allows the drive motor 30 to be coupled with the rotary vane 20, making it possible to rotate axially and obliquely. The outlet direction is also automatically changed. Moreover, the outlet direction may vary uniquely along a circular path, so it is possible to improve on a multidirectional air supply performance. As compared with the prior art, the advantages of the present invention are described herein.

As compared with the oscillating fan of the prior art, the rotary fan of the present invention has concealed rotation, and the outlet direction varies along a circular path, so it is possible to improve multidirectional air supply performance, showing a better applicability than an oscillating fan. Referring to FIG. 13, the left one shows the operating state of the concealed rotary fan A, and the right one shows the operating state of oscillating rotary fan B. It is learnt that, when the air outlet width R1, R2 of the concealed and oscillating rotary fan is the same, the structural width L1 of rotary vane 20 is much lower than L2 of oscillating rotary fan, since the front support 41 is taken as the pivot point by rotary vane 20, namely, the concealed rotary fan is operated in a much smaller space than the oscillating rotary fan.

As compared with the rotating fan of the prior art, since the rotary fan of the present invention automatically changes the outlet direction by coupling the drive motor 30 with the rotary vane 20, the casing is made of thin levers to minimize wind resistance. As the inclined surface construction of the inclined plate will lead to impediment of air current, the rotary fan of the present invention resolves the problem by greatly improving the air supply performance.

As compared with a commonly used industrial rotary fan, since the rotary fan of the present invention automatically changes the outlet direction by coupling the drive motor 30 with the rotary vane 20, it is possible to reduce the probability of personal injury in manually removing the rotary fan, and therefore improve the safety of the present invention.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
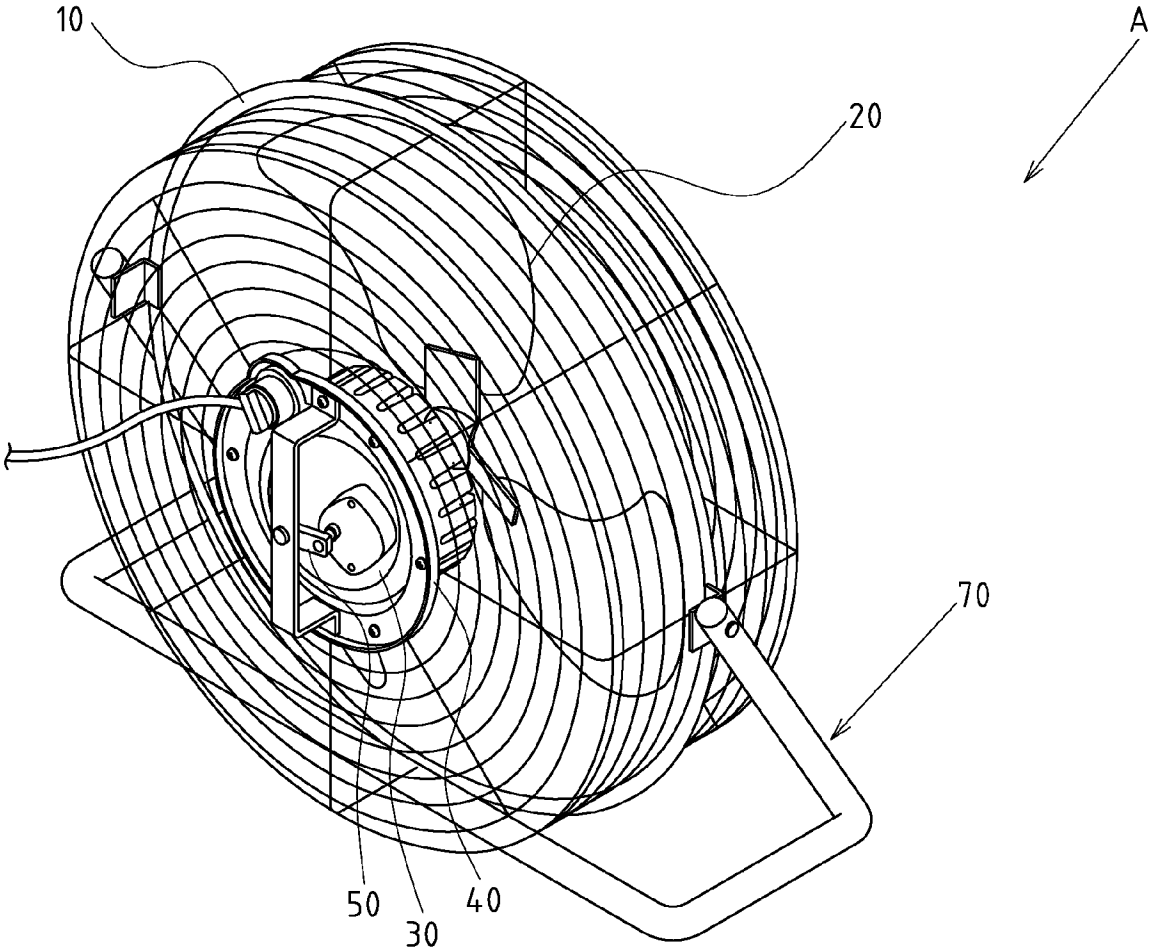
FIG. 1 shows an assembled perspective view of the preferred embodiment of the rotary fan of the present invention.
Figure 2:
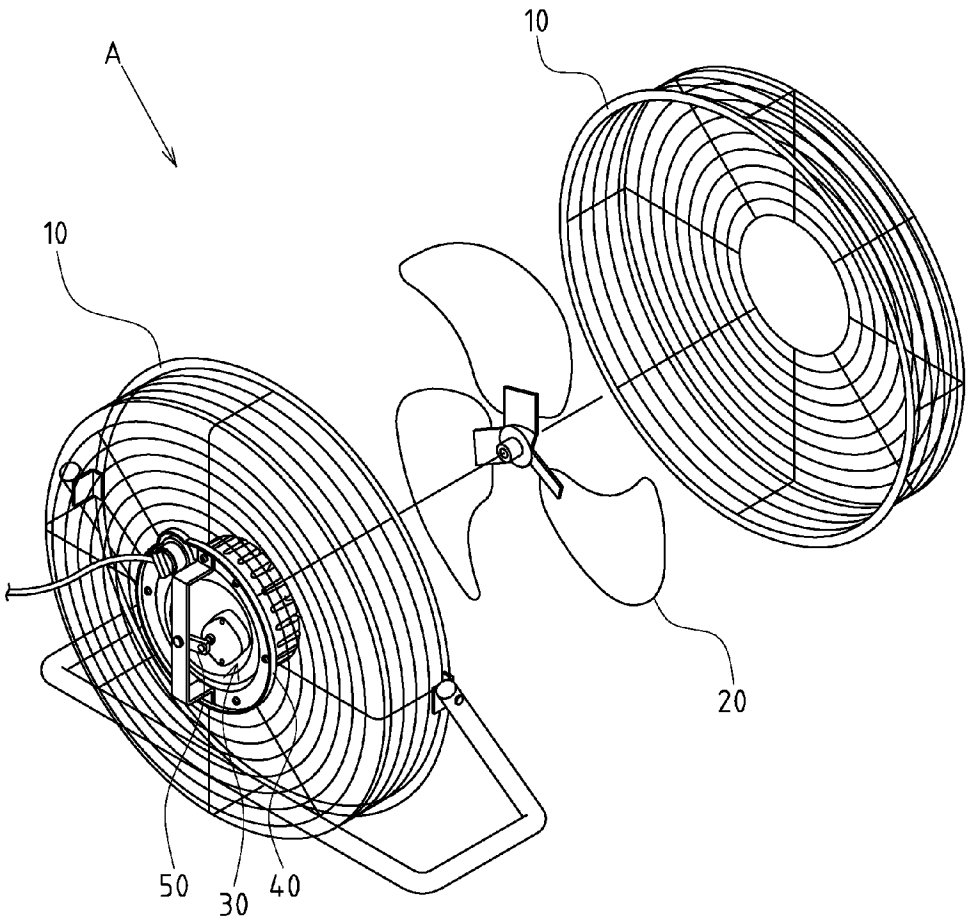
FIG. 2 shows a partially exploded perspective view of the preferred embodiment of the rotary fan of the present invention.
Figure 3:
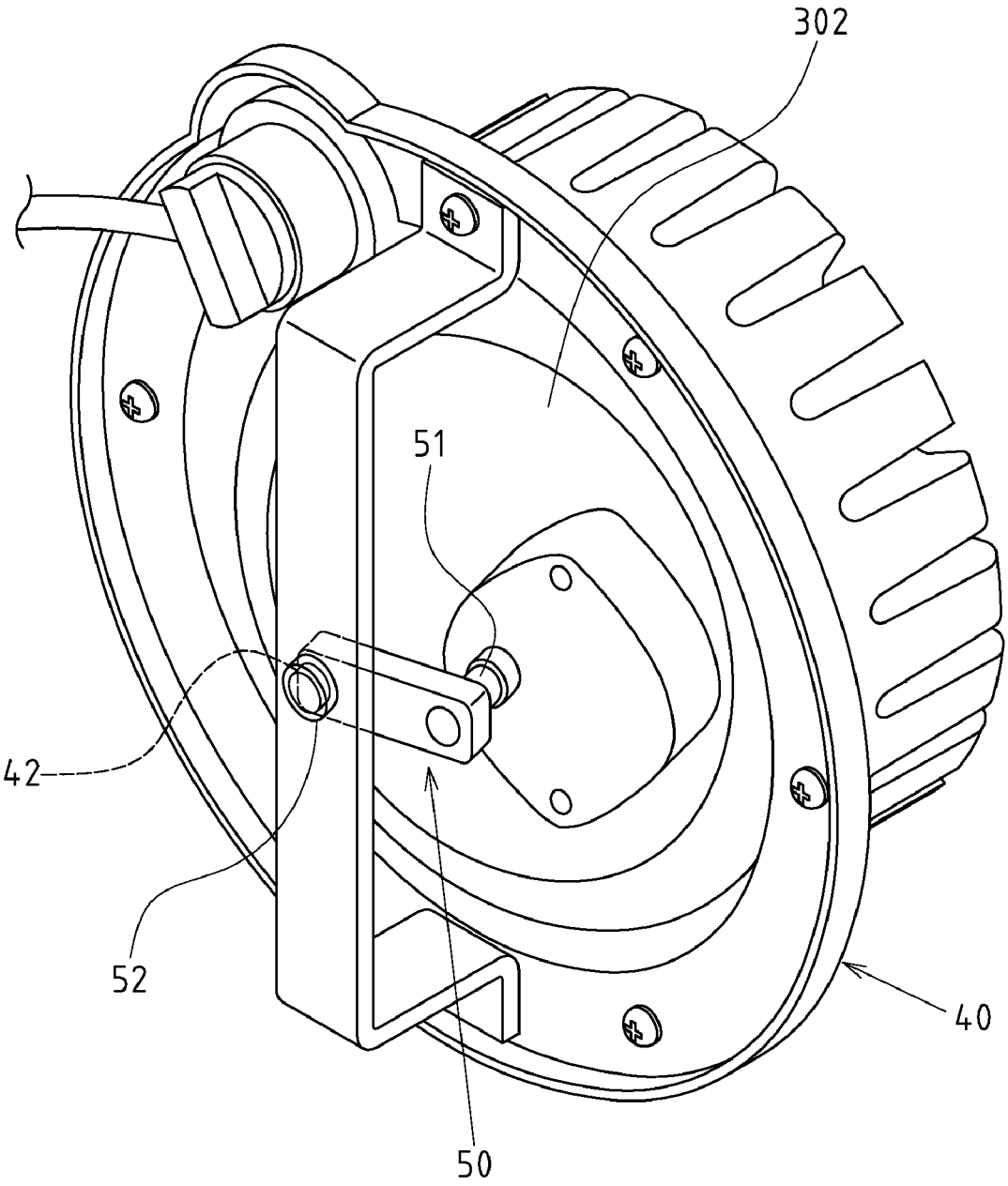
FIG. 3 shows a partially enlarged perspective view of the rotary fan of the present invention.

FIGS. 1-3 depict preferred embodiments of the concealed rotary fan of the present invention. The embodiments are provided for only explanatory purposes.

The rotary fan A comprises a casing 10, a rotary vane 20, a drive motor 30 and a base 40. The casing 10 is provided with a reticulated levers, the rotary vane 20 is assembled onto the revolving shaft 31 of the drive motor 30, the drive motor 30 is located within the base 40, and the casing 10 is externally assembled onto the base 40 to accommodate the rotary vane 20.

The first end 301 of the drive motor 30 with revolving shaft 31 can be assembled onto a front support 41 of the base 40 in a rotary state. The second end 302 of the drive motor 30 is fitted with a crank link 50. The first end 51 is driven by the revolving shaft 31 of the drive motor 30, and the second end 52 is screwed onto a pivot point 42 opposite to the base 40.

Figure 4:
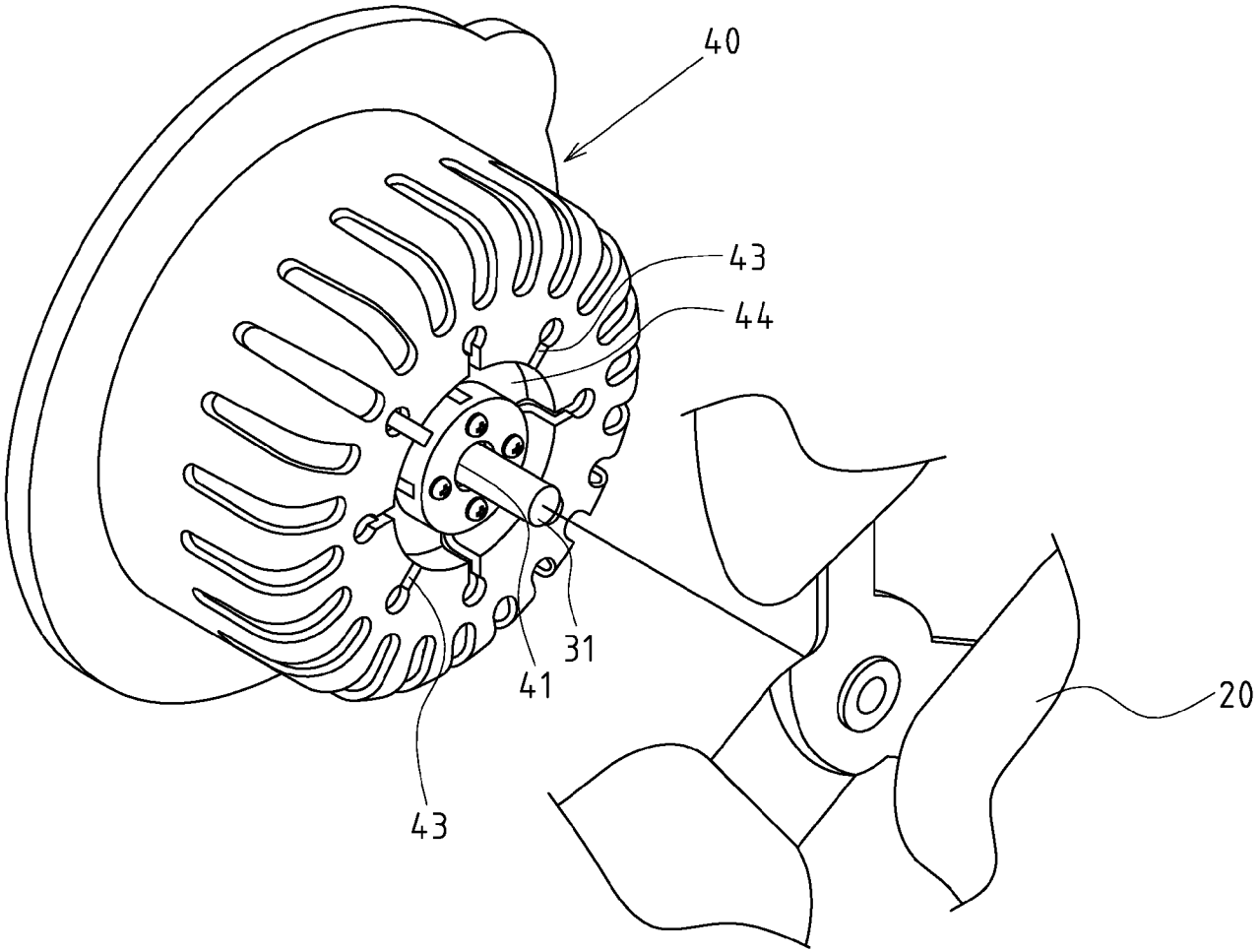
FIG. 4 shows a front perspective view of motor base of the rotary fan of the present invention.
Figure 5:
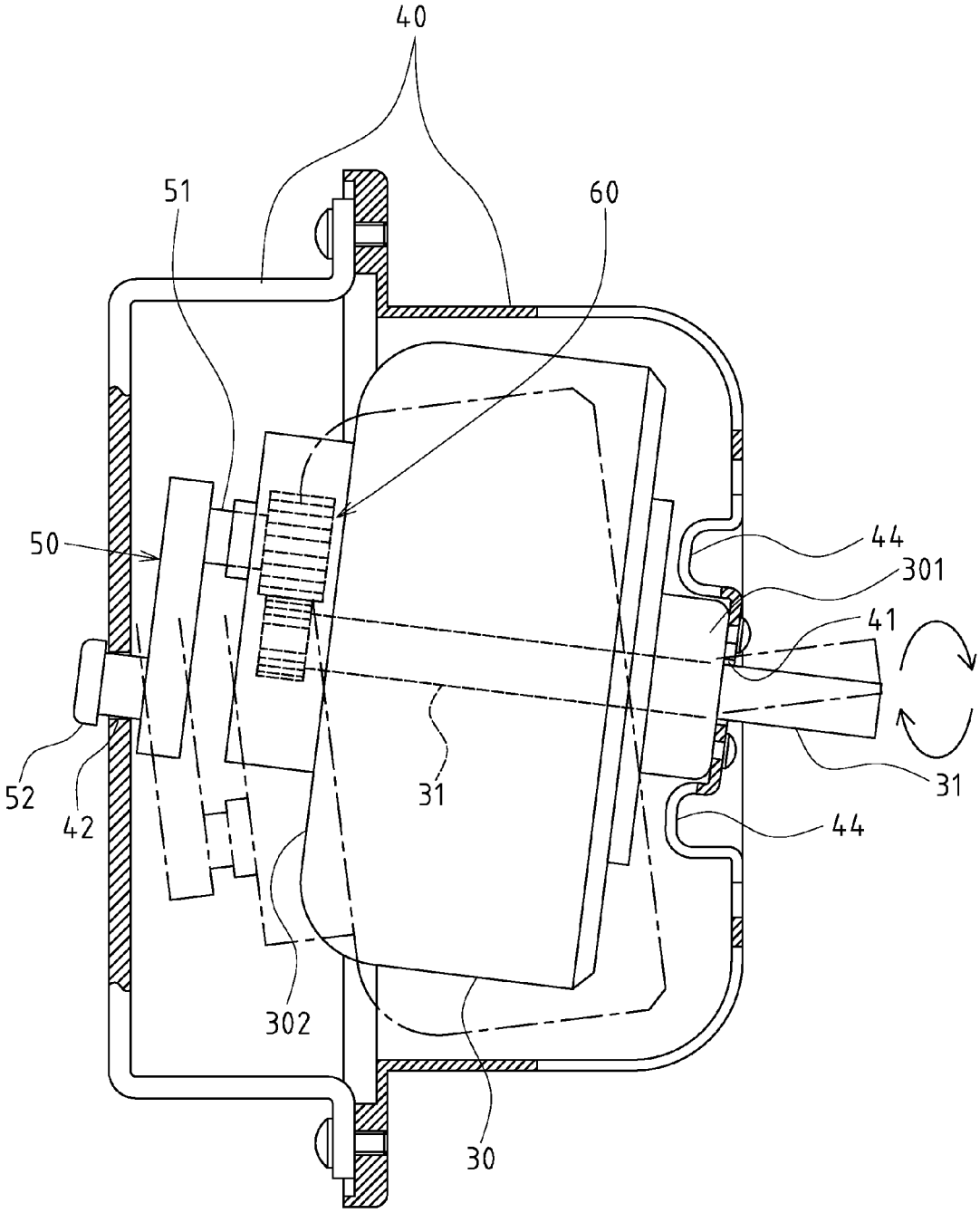
FIG. 5 shows a sectional view of the interior structure and operation of the rotary fan of the present invention.

The front support 41 of the base 40 may be designed into a through-hole. A few hollow portions 43 are arranged at intervals onto the wall of the base 40, and ribs 44 are shaped between the hollow portions 43. Moreover, the cross-section of ribs 44 has a curved shape, as shown in FIGS. 4 and 5, enabling the front support 41 to oscillate flexibly. The front support 41 may also be formed by a universal bearing, ensuring oscillating adaptation of the first end 301 of the drive motor 30.

Referring to FIG. 5, the first end 51 of the crank link 50 and revolving shaft 31 of the drive motor 30 could be coupled through the gear set 60. When the revolving shaft 31 rotates, said gear set 60 may generate a predefined variable-drive, thus enabling the crank link 50 to rotate circularly at a proper speed.

Referring to FIG. 5, the pivot point 42 of the base 40 may be of a through-hole, so that the second end 52 of the crank link 50 is formed by a stud shaft for coupling with the through-hole pivot point 42.

Figure 6:
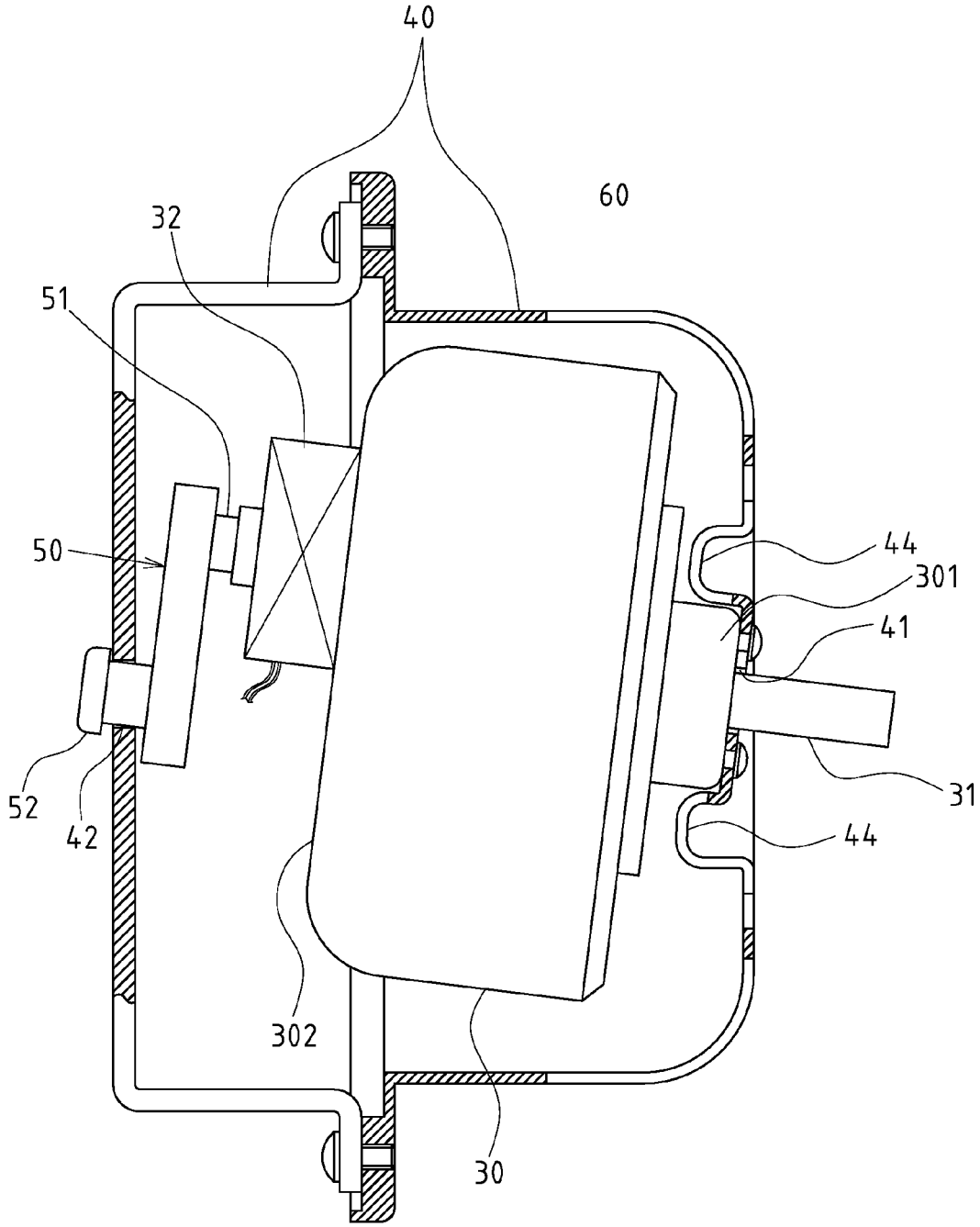
FIG. 6 shows a sectional view of the application of the present invention, wherein the crank link is independently driven by a drive motor.
Figure 12:
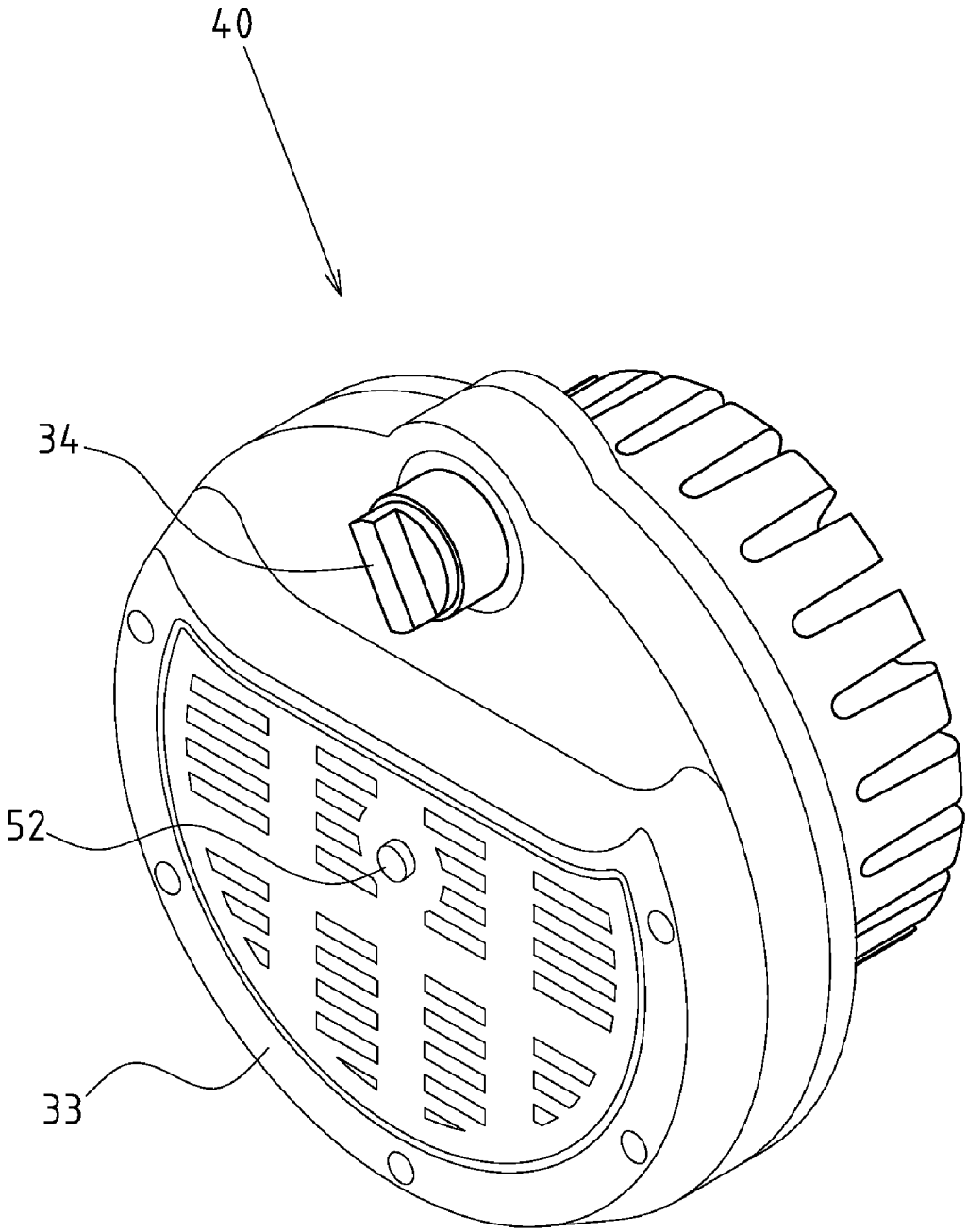
FIG. 12 shows a perspective view of the application of the rotary fan of the present invention, wherein a cover is assembled at the rear of the base.
Figure 13:
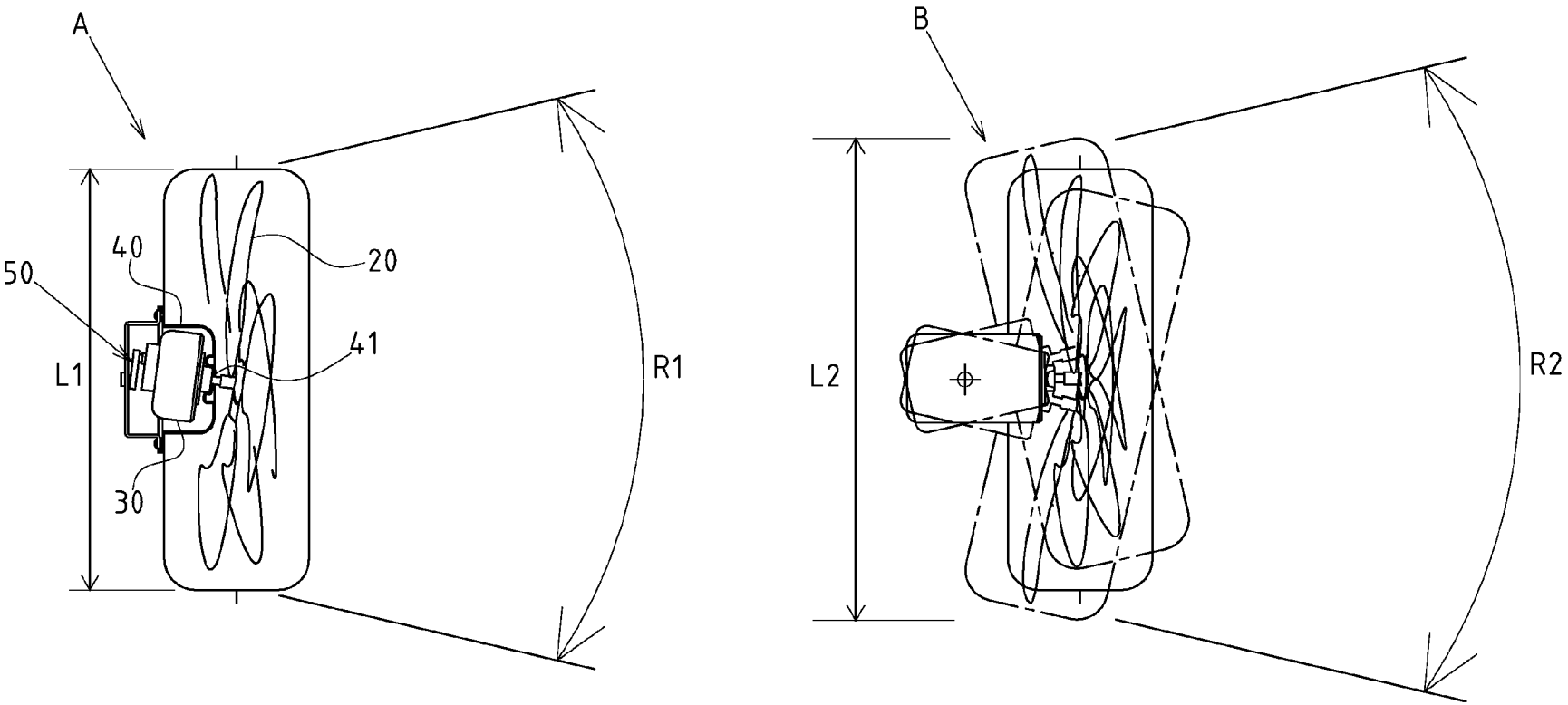
FIG. 13 shows a schematic view of the rotary fan of the present invention in comparison with a typical oscillating fan.

Referring to FIG. 6, the first end 51 of crank link 50 can also be driven independently by a rotary drive motor 32 assembled onto the second end 302 of the drive motor 30, namely, the crank link 50 is operated independently from the revolving shaft 31 of the drive motor 30. Moreover, the rotary fan is fitted with a control switch 34, as shown in FIG. 12, to control the drive motor 32 (i.e. control the rotary vane).

Based upon above-specified structures, the present invention operates as follows.

Figure 8:
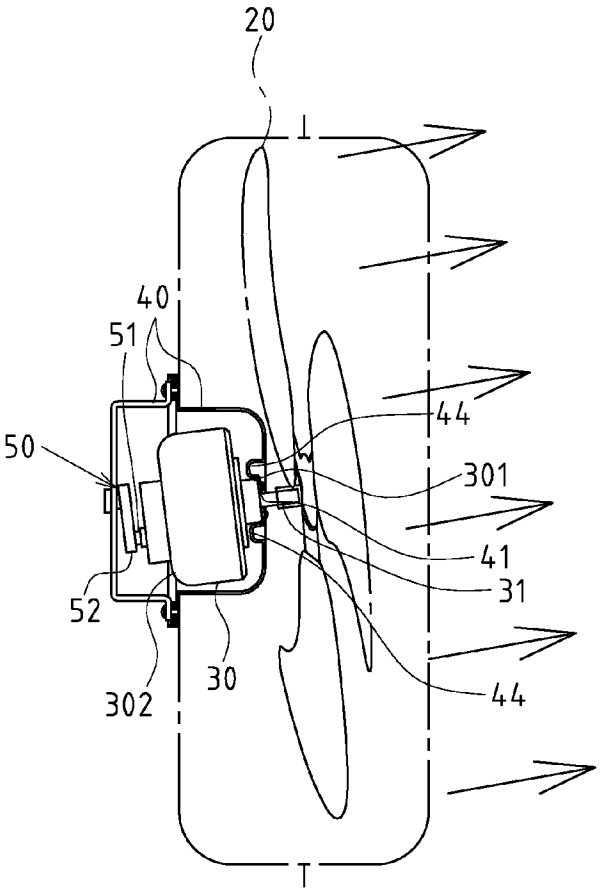
FIG. 8 shows a second schematic view of the overall operation of the rotary fan of the present invention.
Figure 7:
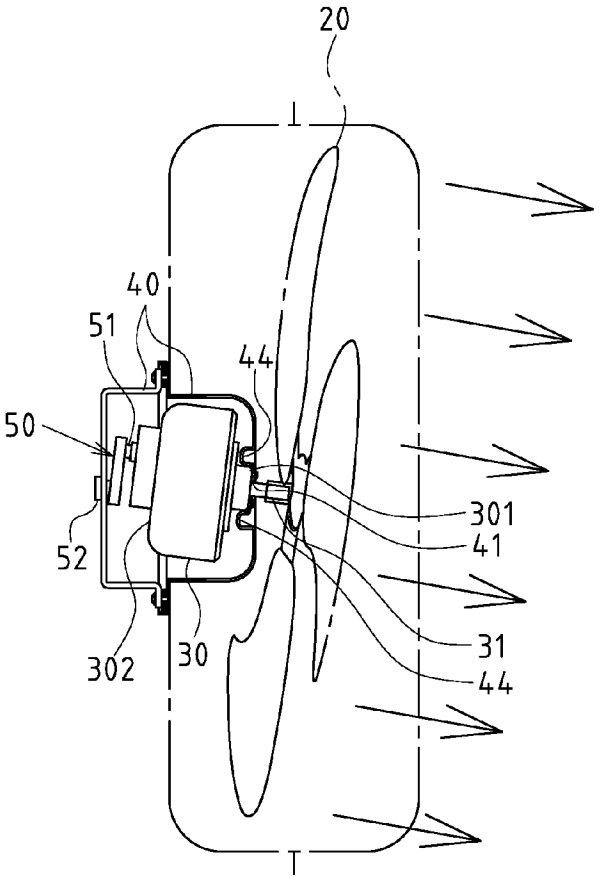
FIG. 7 shows a schematic view of the overall operation of the rotary fan of the present invention.

Referring to FIG. 5, when the drive motor 30 is activated to drive the revolving shaft 31, the gear set 60 will actuate the crank link 50, so that the second end 52 of the crank link 50 rotates circularly, and the drive motor 30 and revolving shaft 31 rotate axially and obliquely. Referring to FIGS. 7 and 8, when the casing 10 is not activated, the rotary fan A of the present invention allows the rotary vane 20 to rotate axially and obliquely, thus changing automatically the outlet direction. Since the outlet direction of the rotary vane 20 may vary uniquely along a circular path, it is possible to improve multidirectional air supply performance.

Referring to FIG. 1, the casing 10 may be fitted with a pedestal 70, so that the rotary fan A could be placed reliably on the ground or table.

Figure 9:
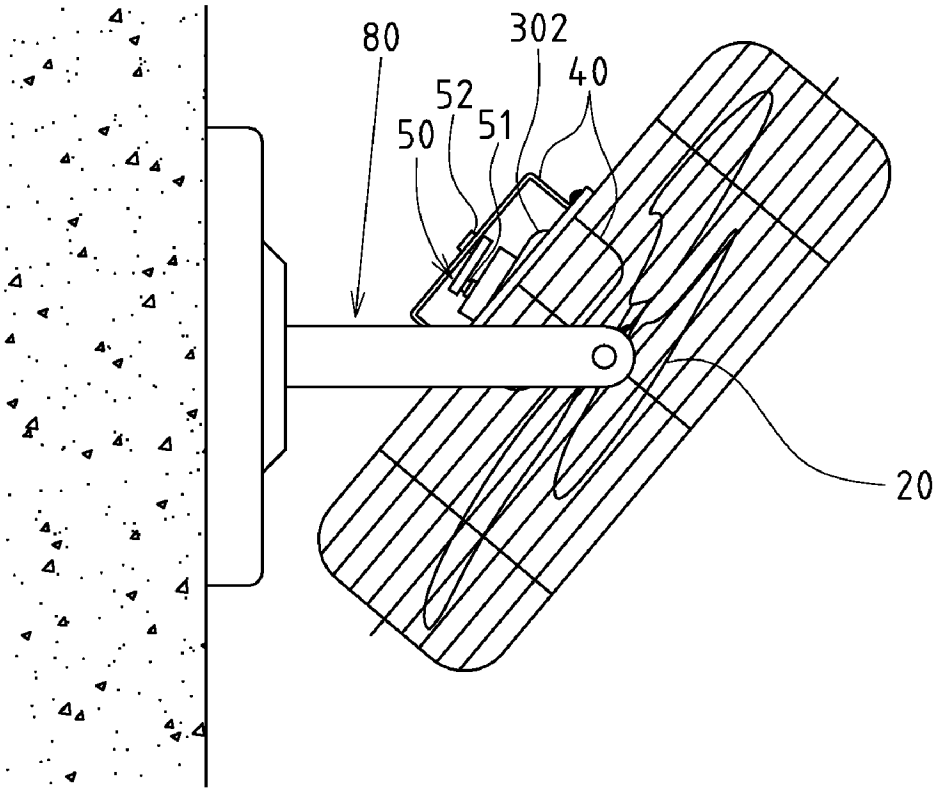
FIG. 9 shows another schematic view of the application of the rotary fan of the present invention in an assembled state.

Referring also to FIG. 9, the casing 10 may also be fitted with a wall shelf 80, namely, the rotary fan A can be wall-mounted through the wall shelf 80.

Figure 10:
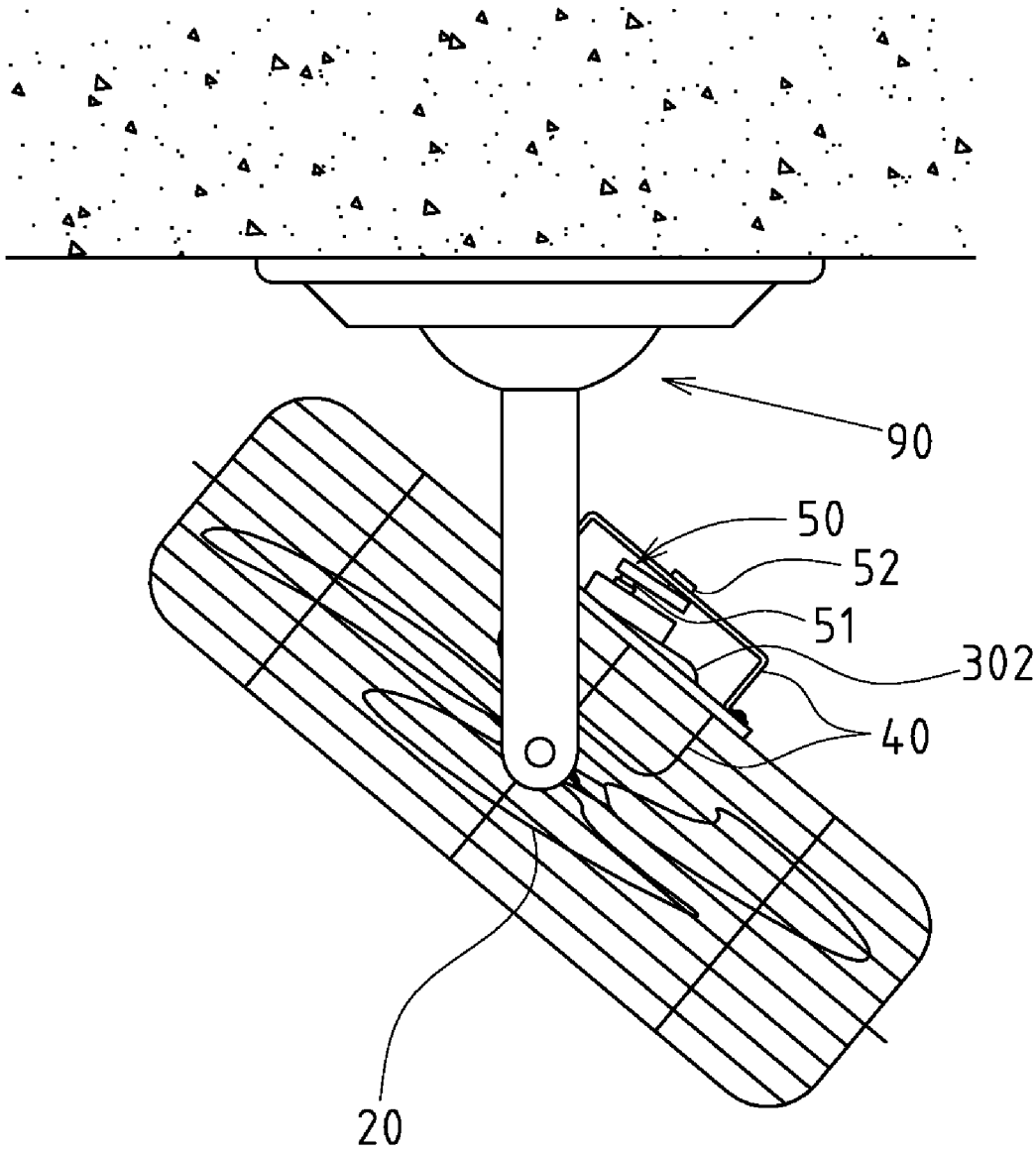
FIG. 10 shows still another schematic view of the application of the rotary fan of the present invention in the assembled state.

Referring also to FIG. 10, the casing 10 may also be fitted with a hanger 90, namely, the rotary fan A can be ceiling-mounted through the hanger 90.

Figure 11:
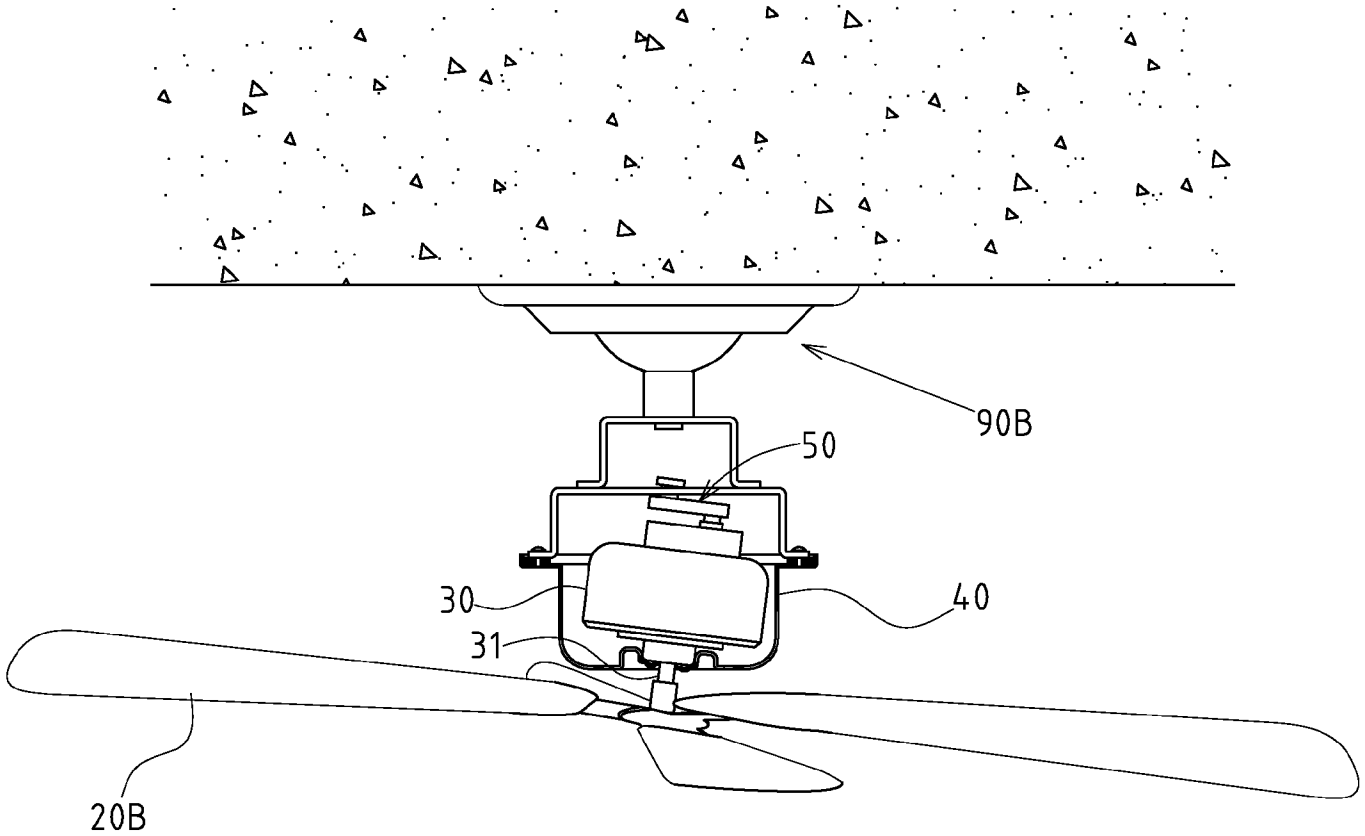
FIG. 11 shows a schematic view of the application of the present invention, wherein the rotary fan is applied to the ceiling fan.

Referring also to FIG. 11, the rotary fan A can also be used as a ceiling fan with a longer rotary vane 20B, but without the aforementioned casing 10. A hanger 90B is assembled on the top of base 40 to lift and position the rotary fan A onto the ceiling, thus enabling the rotary vane 20B of the ceiling fan to rotate axially and obliquely.

Referring also to FIG. 12, a cover 33 is also assembled at the rear of the base 40 to shield said drive motor and crank link.

I claim:

1. A concealed rotary fan, comprising:

a rotary vane;

a drive motor having a revolving shaft, said rotary vane being assembled on said revolving shaft; and a base, said drive motor being located within said base, wherein said drive motor has a first end assembled onto a front support of said base in a rotary state a second end fitted with a crank link, said first end being driven by said revolving shaft, said second end being screwed onto a pivot point opposite said base.

2. The fan defined in claim 1, wherein said crank link has a first end coupled with said revolving shaft through a gear set and a second end, said revolving shaft being rotatable, said second end of said crank link being synchronously rotatable, enabling said drive motor and said revolving shaft to rotate axially and obliquely along with said rotary vane.

3. The fan defined in claim 1, wherein said front support is formed by a through-hole of said base, a plurality of hollow portions arranged at intervals onto a wall of said base, and a plurality of ribs shaped between said hollow portions, each rib having a cross-section of a curved shape, enabling said front support to oscillate flexibly.

4. The fan defined in claim 1, wherein said front support is a universal bearing.

5. The fan defined in claim 1, wherein said first end of said crank link is driven independently by a rotary drive motor assembled onto said second end of said drive motor.

6. The fan defined in claim 5, further comprising:

a control switch fitted to said drive motor.

7. The concealed rotary fan defined in claim 1, wherein said pivot point is comprised of a through-hole, said second end of said crank link being a stud shaft coupling with said pivot point.

8. The fan defined in claim 1, further comprising:

a casing, externally assembled onto said base to accommodate said rotary vane.

9. The fan defined in claim 8, wherein said casing is fitted with a pedestal.

10. The fan defined in claim 8, wherein said casing is fitted with a wall shelf.

11. The fan defined in claim 8, wherein said casing is fitted with a hanger.

12. The fan defined in claim 1, wherein said base is with a hanger.

* * * * *